US007404526B2

(12) United States Patent
Cooke et al.

(10) Patent No.: US 7,404,526 B2
(45) Date of Patent: Jul. 29, 2008

(54) INJECTION NOZZLE

(75) Inventors: Michael P. Cooke, Gillingham (GB); Andrew J. Limmer, Bury St. Edmunds (GB); Louise A. Connelly, Rainham (GB)

(73) Assignee: Delphi Technologies, Inc., Troy, MI (US)

( * ) Notice: Subject to any disclaimer, the term of this patent is extended or adjusted under 35 U.S.C. 154(b) by 367 days.

(21) Appl. No.: 11/061,211

(22) Filed: Feb. 18, 2005

(65) Prior Publication Data

US 2005/0189440 A1 Sep. 1, 2005

(30) Foreign Application Priority Data

Feb. 20, 2004 (EP) ..... 04250928

(51) Int. Cl.
*F02M 61/10* (2006.01)

(52) U.S. Cl. ..... 239/533.11; 239/102.2; 239/444; 239/533.3; 239/533.12

(58) Field of Classification Search ..... 239/89–92, 239/533.2, 533.8, 533.9, 585.1, 584, 585.5, 239/102.2, 533.11, 533.12, 533.3, 444
See application file for complete search history.

(56) References Cited

U.S. PATENT DOCUMENTS 5,165,656 A * 11/1992 Maier et al. ..... 251/129.21
5,301,874 A * 4/1994 Vogt et al. ..... 239/585.4
5,899,389 A 5/1999 Pataki et al.
6,000,638 A * 12/1999 Martin ..... 239/533.2
6,427,932 B1 8/2002 Danckert et al.

(Continued)

FOREIGN PATENT DOCUMENTS

EP 0 967 382 12/1999

(Continued)

*Primary Examiner*—Kevin Shaver
*Assistant Examiner*—Jason Boeckmann
(74) *Attorney, Agent, or Firm*—David P. Wood

(57) ABSTRACT

An injection nozzle for an internal combustion engine, the injection nozzle including an outer valve needle which is engageable with an outer valve seating so as to control injection through a first nozzle outlet, an inner valve needle which is movable within the outer valve needle and engageable with an inner valve seating so as to control injection through a second nozzle outlet, and a coupling arrangement for coupling movement of the outer valve needle to the inner valve needle in circumstances in which the outer valve needle is moved away from the outer valve seating beyond a predetermined amount, thereby to permit fuel injection through both the first and second nozzle outlets. The outer valve seating defines first and second seats for the outer valve needle, wherein co-operation between the outer valve needle and the first seat controls fuel flow between a first delivery chamber and the first nozzle outlet and co-operation between the outer valve needle and the second seat controls fuel flow between a second delivery chamber and the first nozzle outlet. The second delivery chamber communicates with the first delivery chamber by way of a supplementary flow path defined, at least partially, within the outer valve needle. The coupling arrangement includes a resilient member carried by the outer valve needle, the resilient member being brought into engagement with the inner valve needle following movement of the outer valve needle beyond the predetermined amount so as to cause the inner valve needle to move together with the outer valve needle.

20 Claims, 5 Drawing Sheets

U.S. PATENT DOCUMENTS

| | | | | |
|---|---|---|---|---|
| 6,676,045 | B2 * | 1/2004 | Reiter | 239/585.1 |
| 6,758,407 | B1 * | 7/2004 | Lambert et al. | 239/5 |
| 6,902,124 | B2 * | 6/2005 | Arndt et al. | 239/533.2 |
| 2001/0052554 | A1 | 12/2001 | Lambert et al. | |
| 2003/0052203 | A1 * | 3/2003 | Arndt et al. | 239/585.5 |

FOREIGN PATENT DOCUMENTS

| | | |
|---|---|---|
| FR | 2328855 | 5/1977 |
| JP | 2002/54522 | 8/2000 |
| WO | 03/040543 | 5/2003 |
| WO | 03/044358 | 5/2003 |
| WO | 2004/074677 | 9/2004 |

* cited by examiner

INJECTION NOZZLE

The present invention relates to an injection nozzle for use in a fuel injection system for an internal combustion engine. It relates particularly, but not exclusively, to an injection nozzle for use in a compression ignition internal combustion engine, in which first and second valve needles are operable to control injection of fuel into an associated combustion space through a plurality of nozzle outlets.

A so-called variable injection nozzle has at least two outlet openings through which fuel is injected into an associated combustion cylinder, with first and second valve needles being operable to control whether injection occurs through only one of the outlets or through both of the outlets together. In one known injection nozzle of this type, the fuel flow to a first set of nozzle outlets is controlled by an outer valve needle. The flow to a second set of nozzle outlets is controlled by an inner valve needle which is lifted by the outer valve needle only after the flow of fuel through the first set of nozzle outlets reaches a sufficient rate. This arrangement enables the selection of a large total nozzle outlet area for high power modes, and a small total nozzle outlet area for optimum engine emissions for low to medium power modes. The injection nozzle therefore has a greater versatility than single-stage injection nozzles, in which only a single valve needle controls injection through one nozzle outlet, or through a single set of nozzle outlets.

There are, however, two main problems with variable injection nozzles of the aforementioned type. Firstly, the total valve needle lift requirement is large compared to a single stage injection nozzle which has only a single valve needle. Secondly, a chamber formed between the inner and outer valve needles is in fluid communication with the first set of nozzle outlets between injections events. The fuel in this chamber can be ejected from the nozzle outlets late in the combustion cycle thereby causing the engine to produce hydrocarbon emissions, i.e. unburnt or partially burnt fuel in the exhaust.

In one type of variable orifice injection nozzle, a piezoelectric actuator is implemented to lift the valve needle. An actuator have a piezoelectric stack is energised and de-energised repeatedly so as to control stack length and, hence, movement of the nozzle valve needle. The energy required to lift the valve needle is thus provided electrically, which has a direct effect on stack volume (i.e. width, length and depth) and the overall reliability of the actuator. As the effect of the fuel volume during injection is becoming more critical for current engine emissions requirements, accuracy of control and repeatability of injector performance are increasingly important. To pass proposed emissions regulations, for example, engines are being run with high levels of exhaust gas recirculation in low and medium power modes, meaning that the lower level of available oxygen reduces the chance of poorly atomised fuel being burnt.

It is an object of the present invention to provide an improved variable orifice injection nozzle, which is capable of achieving current and future emissions requirements whilst overcoming the disadvantages of the prior art.

According to a first aspect of the present invention, there is provided an injection nozzle for an internal combustion engine, the injection nozzle including an outer valve needle which is engageable with an outer valve seating so as to control injection through a first nozzle outlet, an inner valve needle which is movable within the outer valve needle and engageable with an inner valve seating so as to control injection through a second nozzle outlet, and a coupling arrangement for coupling movement of the outer valve needle to the inner valve needle in circumstances in which the outer valve needle is moved away from the outer valve seating beyond a predetermined amount, thereby to permit fuel injection through both the first and second nozzle outlets. The outer valve seating defines first and second seats for the outer valve needle wherein co-operation between the outer valve needle and the first seat controls fuel flow between a first delivery chamber and the first nozzle outlet and co-operation between the outer valve needle and the second seat controls fuel flow between a second delivery chamber and the first nozzle outlet. The second delivery chamber communicates with the first delivery chamber by way of a supplementary flow path defined, at least partially, within the outer valve needle. Further, the coupling arrangment includes a resilient member carried by the outer valve needle, the resilient member being brought into engagement with the inner valve needle following movement of the outer valve needle beyond the predetermined amount so as to cause the inner valve needle to move together with the outer valve needle.

The injection nozzle of the present invention enables a reduced lift force to be applied to the outer valve needle by the injector actuator, whilst still achieving acceptable flow to the first outlet. A reduced lift force can be used due to fuel flowing past two seats to the first outlet. This differs from known variable orifice nozzles, where flow to the nozzle outlets flows past only a single seat. The reduced demand on the actuator prolongs the service life of this relatively expensive injector component. Additionally, control of injection is improved to help meet emissions requirements.

In a preferred embodiment, the outer valve needle is provided with an axial bore within which the inner valve needle is received, and wherein the supplementary flow-path is defined, in part, by a region of the axial bore.

In a preferred embodiment, the supplementary flow path is further defined by at least one radial passage provided in the outer valve needle, wherein the radial passage effects communication between the first delivery chamber and the axial bore in the outer valve needle.

In one embodiment, the resilient member takes the form of an elongate member having lateral resilience, for example a spring pin of generally C-shaped cross section. A part of the inner valve needle is received within the spring pin and is movable within said pin upon movement of the outer valve needle away from the outer valve needle seating by less than the predetermined amount.

Preferably, the resilient member is carried by the outer valve needle through frictional engagement between these parts. For example, an outer surface of the spring pin is in frictional engagement with the outer valve needle to couple the spring pin and the outer valve needle together.

In a further preferred embodiment, the resilient member includes a first contact surface for engagement with a second contact surface of the inner valve needle, the surfaces being substantially flat. In an alternative preferred embodiment, said contact surfaces are of substantially frusto-conical form.

The latter embodiment may be advantageous as it provides a stronger inner valve needle structure. In particular, the resilient member defines a first upper conical surface and the enlarged end of the inner valve needle defines a correspondingly shaped second upper conical surface for engagement with said first upper conical surface of the resilient member, wherein said upper surfaces define therebetween a clearance distance equal to the predetermined amount when the inner and outer valve needles are seated, and wherein said outer valve member is movable away from the outer valve seating through the predetermined distance so as to engage said upper contact surfaces, thereby causing any further movement of the outer valve needle away from the outer valve seating to be imparted to the inner valve needle.

In a further preferred embodiment, the inner valve needle includes a seating region which is engageable with the inner valve seating, the seating region including a region of part-spheroid form which defines, together with the inner valve seating, a seat restriction through which fuel flows between the second delivery chamber and the second nozzle outlet in circumstances in which the inner valve needle is lifted away from the inner valve seating.

Preferably, the seating region includes a region of conical form downstream of the part-spheroid region so as to have a decelerating effect on fuel flow velocity downstream of the seat restriction. This is beneficial as it ensures that the highest possible pressure is recovered in the nozzle sac volume, downstream of the seat restriction, before the fuel flows into the second outlet. This ensures a good flow characteristic is achieved to the second outlet, without the requirement for excessive lift distances for the inner valve needle which are required for known seat geometries.

According to a second aspect of the present invention, there is provided an injection nozzle for an internal combustion engine, the injection nozzle including an outer valve needle which is engageable with an outer valve seating so as to control injection through a first nozzle outlet and an inner valve needle which is movable within the outer valve needle and engageable with an inner valve seating so as to control injection through a second nozzle outlet. The outer valve seating defines first and second seats for the outer valve needle, wherein co-operation between the outer valve needle and the first seat controls fuel flow between a first delivery chamber and the first nozzle outlet and co-operation between the outer valve needle and the second seat controls fuel flow between a second delivery chamber and the first nozzle outlet, the second delivery chamber communicating with the first delivery chamber by way of a supplementary flow path defined, at least partially, within the outer valve needle. The inner valve needle includes a seating region which is engageable with the inner valve seating wherein the seating region includes a region of part-spheroid form defining, together with the inner valve seating, a seat restriction through which fuel flows between the second delivery chamber and the second nozzle outlet in circumstances in which the inner valve needle is lifted away from the inner valve seating.

Preferably, the seating region may include a region of conical form downstream of the part-spheroid region so as to have a decelerating effect on fuel flow velocity downstream of the seat restriction.

In a preferred embodiment, the injection nozzle includes a coupling arrangement for coupling movement of the outer valve needle to the inner valve needle in circumstances in which the outer valve needle is moved away from the outer valve seating beyond a predetermined amount, thereby to permit fuel injection through both the first and second nozzle outlets.

Optional or preferred features of the first aspect of the invention may also be incorporated in the second aspect of the invention.

In another aspect the invention provides an -injector for use in a fuel injection system of an internal combustion engine, the injector including an injection nozzle in accordance with the first or second aspect of the invention and an actuator for actuating movement of the outer valve needle. Preferably, the actuator is of the piezoelectric type to realise the advantages of the invention.

In another aspect, there is provided an injector for use in a fuel injection system of an internal combustion engine, wherein the injector includes an injection nozzle according to the second aspect of the present invention, a first actuator for actuating movement of the outer valve needle and a second actuator for actuating movement of the inner valve needle.

The invention is particularly applicable to piezoelectrically actuated fuel injectors due to the benefits of the outer valve needle having two seats, as described previously, which allows reduced lift forces to be used. The service life of the actuator is therefore prolonged and performance is improved.

The invention will be described, by way example only, with reference to the accompanying drawings, in which.

The injection nozzle of the present invention is of the variable orifice nozzle type and includes first and second valve needles for controlling injection through respective first and second sets of nozzle outlets provided in an injection nozzle body. The injection nozzle is particularly suitable for implementation within an injector having a piezoelectric actuator for controlling movement of the valve needles.

Figure 1:
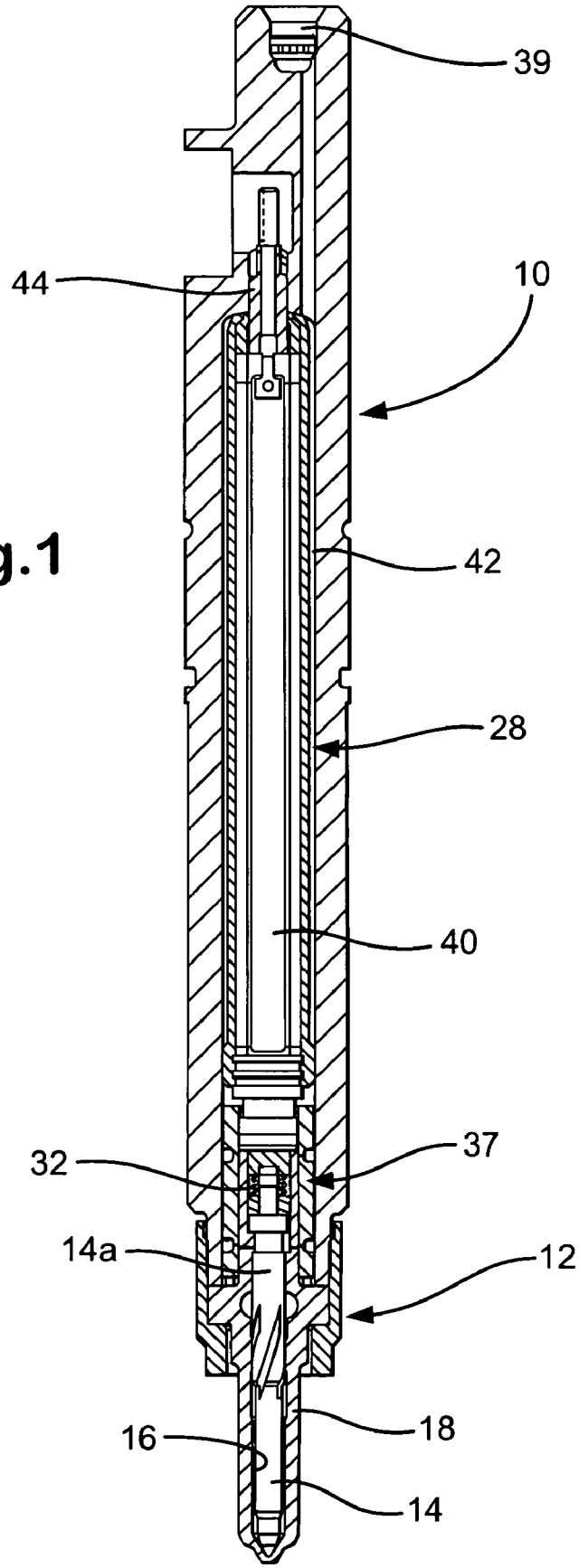
FIG. 1 is a sectional view of an injector incorporating an injection nozzle in accordance with the present invention.

FIG. 1 shows a piezoelectric injector, referred to generally as 10, within which the injection nozzle of the present invention may be incorporated. The injection nozzle is referred to generally as 12. Only certain elements of the injection nozzle 12 are visible in FIG. 1, but details can be seen more clearly in the enlarged cross section shown in FIG. 2.

Figure 2:
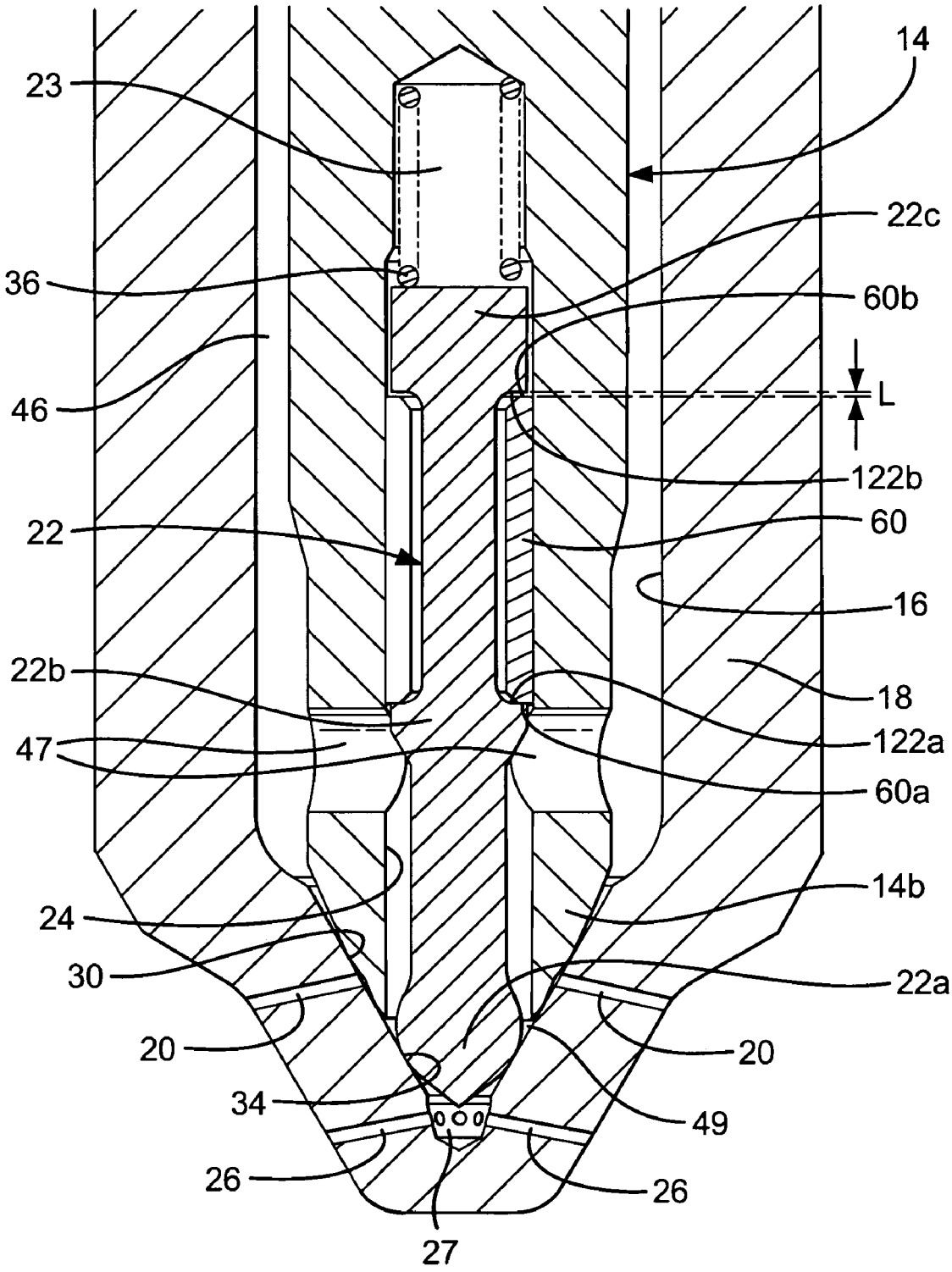
FIG. 2 is a sectional view of a first embodiment of the injection nozzle when in a closed state (non-injecting)

Referring to FIGS. 1 and 2, an outer valve needle 14 of the nozzle 10 is movable within a blind bore 16 provided in a nozzle body 18 so as to control fuel injection through a first set of outlet openings 20 (visible only in FIG. 2). The injection nozzle also includes an inner valve needle 22 which is slidably mounted within an axial bore 24 provided in a lower region of the outer valve needle 14. Movement of the inner valve needle 22 controls fuel injection through a second set of outlets 26 (visible only in FIG. 2). The blind end of the nozzle body bore 16 defines a sac volume 27, with which inlet ends of the second set of outlets 26 communicate. The first and second sets of outlets 20, 26 are shown as having two or more outlets in each set, although equally each set may be replaced by just a single outlet, one being at a first axial height along the nozzle body 18 and one being at a second, different height along the nozzle body 18. For the purpose of this specification, any reference to "outlet" shall therefore be taken to mean one or more outlets.

The outer valve needle 14 is biased towards an outer valve seating 30, of substantially frustoconical form, by means of a first closing spring 32 (visible only in FIG. 1) and is actuated to move away from the outer valve seating 30, against the spring force, by means of a piezoelectric actuator 28. The inner valve needle 22 is biased towards an inner valve seating 34 by means of a second closing spring 36 and is actuated to move away from the inner valve seating 34, against the spring force, upon movement of the outer valve needle 14 beyond a predetermined amount, as described in further detail below. The inner valve seating 34 is located downstream of the outer valve seating 30, both seatings 30, 34 being defined by a lower region of the nozzle body bore 16. The second closing spring 36 is located within a spring chamber 23 defined at an upper end of the axial bore 24 in the outer valve needle 14. Typically, the first and second closing springs 32, 36 may be helical compression springs, although other types of resilient biasing components may be used as alternatives. The provision of the springs 32, 36 ensures that the valve needles 14, 22 remain seated at times when there is no fuel pressure in the injector.

The piezoelectric actuator 28 includes a stack 40 of piezoelectric elements, the stack 40 being arranged within an injector accumulator volume 42 which is filled with high pressure fuel so as to apply a hydrostatic loading to the stack 40. The piezoelectric stack 40 has an associated electrical connector 44 for allowing a variable voltage to be applied across the stack 40. The actuator 28 is coupled to the outer valve needle 14 via an appropriate coupling arrangement, such as a hydraulic amplifier arrangement 37. Thus, by varying the voltage across the piezoelectric stack 40, the length of the stack 40 is varied to control movement of the outer valve needle 14 through the hydraulic amplifier 37.

Fuel is delivered to the injector through an inlet 39 (visible in FIG. 1), for example a common rail or other common fuel volume, which is also arranged to supply fuel to one or more other injectors of the engine also. The inlet 39 supplies fuel to the accumulator volume 42 and from here fuel is supplied to a first, upper delivery chamber 46. The upper delivery chamber 46 is defined between the outer surface of the outer valve needle 14 and the nozzle body bore 16 in a region upstream of the outer valve seating 30. The outer valve needle 14 is provided with radial cross drillings 47, wherein one end of each drilling 47 communicates with the upper delivery chamber 46 and the other end of each drilling 47 communicates with the needle bore 24. The radial drillings 47 define a part of a flow path for fuel between the upper delivery chamber 46 and a second, lower delivery chamber 49 located downstream of the first outlets 20. From the lower delivery chamber 49, fuel is able to flow into the first outlets 20 when the outer valve needle 14 is lifted away from the outer valve seating 30, and also into the second, outlets 26 when the inner valve needle 22 is lifted away from the inner valve seating 34, as will be discussed further below.

The outer valve needle 14 includes an upper end region 14*a* (only visible in FIG. 1) having a diameter which is substantially equal to that of the nozzle body bore 16 so that co-operation between these parts serves to guide movement of the outer valve needle 14 as it moves within the nozzle body bore 16, in use. The lower region of the outer valve needle 14 includes a seating region 14*b* which is shaped for engagement with the outer valve seating 30.

Figure 3:
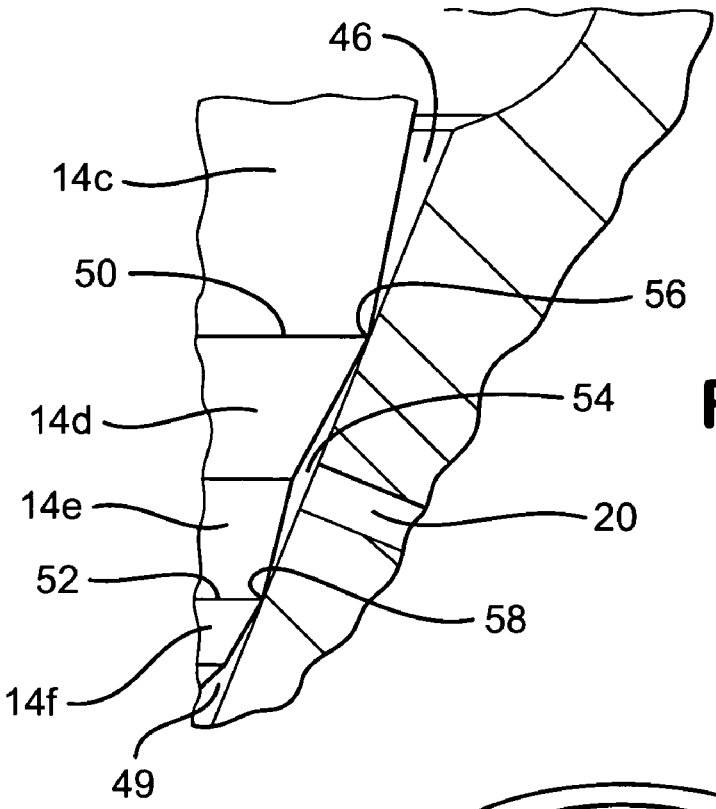
FIG. 3 is an enlarged view of a part of the outer valve needle of the injection nozzle in FIG. 2.

As shown more clearly in FIG. 3, it is a particular feature of the invention that the outer surface of the outer valve needle 14 is shaped to define a first (upper) seating line 50 upstream of the first outlets 20 and a second (lower) seating line 52 downstream of the first outlets 20. The outer valve needle 14 is provided with a grooved or recessed region which define, at respective upper and lower edges thereof, the upper and lower seating lines 50, 52.

Four distinct regions of the outer valve needle 14 are visible in FIG. 3: an upper region 14*c*, an upper seat region 14*d*, a lower seat region 14*e* and an end region 14*f*. For clarity, the regions 14*c*-14*f* of the outer valve needle 14 are not identified in FIG. 2. The upper seat region 14*d* and the lower seat region 14*e* together form the recessed region of the outer valve needle 14 and define, together with the adjacent region of the bore 16, an annular volume 54 for fuel at the inlet end of the first outlets 20. The upper edge of the upper seat region 14*c* defines the upper seating line 50 and the lower edge of the lower seat region 14*e* defines the lower seating line 52. When the outer valve needle 14 adopts its seated position against the outer valve seating 30, both the upper and lower seating lines 50, 52 engage with the outer valve seating 30 at respective first and second seats 56, 58, thereof.

Referring again to FIG. 2, the inner valve needle 22 is shaped to include three distinct regions: a lower region 22*a*, a stepped region 22*b* and an upper enlarged end region 22*c*. The lower region of the inner valve needle 22 forms a seating region 22*a* for the inner valve needle 22 which is shaped for engagement with the inner valve seating 34. The seating region 22*a* is engageable with the inner valve seating 34 so as to control injection through the second outlets 26. It is a particular feature of the seating region 22*a* that it is of part-spheroid form, tapering or blending into a region of conical form which terminates at a cone tip.

Figure 4:
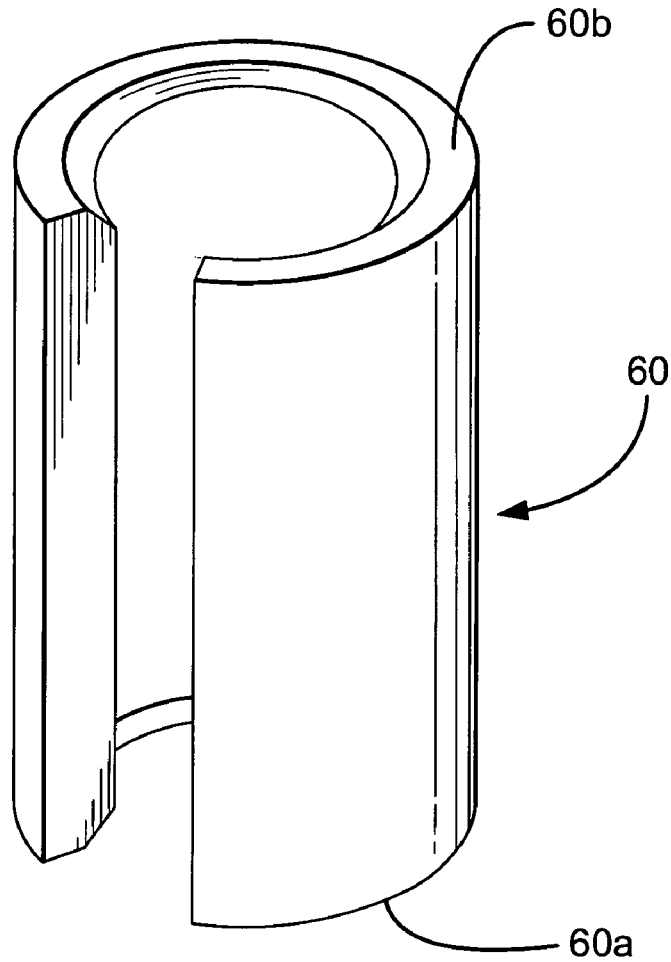
FIG. 4 is an enlarged view of a spring pin forming part of the injection nozzle in FIG. 2.

The outer valve needle 14 is coupled to, or carries, a resilient member 60 in the form of a spring pin 60, as shown in further detail in FIG. 4. The spring pin 60 is of generally C-shaped cross section and is coupled to the outer valve needle 14 through frictional contact between its outer surface and the surface of the bore 24 in the outer valve needle 14. The spring pin has lateral (as opposed to axial) resilience, and it is this resilience that provides a frictional coupling between the parts 60, 14. The outer diameter of the spring pin 60 is selected so as to be slightly greater than the internal diameter of the axial bore 24 in the outer valve needle 14, so that with the inner valve needle and spring pin assembly 22, 60 received within the axial bore 24 of the outer valve needle 14, the lateral resilience of the spring pin 60 serves to urge the outer surface of the spring pin 60 into frictional contact with the bore surface.

The spring pin 60 has lower and upper end surfaces, 60*a*, 60*b* respectively, which are substantially flat. As identified in FIG. 2, the stepped region 22*b* and the enlarged end region 22*c* of the inner valve needle 22 define corresponding flat surfaces, 122*a*, 122*b* respectively. The lower end surface 60*a* of the spring pin 60 defines an abutment surface for the stepped region 22*b* of the inner valve needle 22. The upper end surface 60*b* of the spring pin 60 is engageable with the surface 122*b* of the enlarged end 22*c* of the inner valve needle 22 to provide a means for coupling movement of outer valve needle 14 to the inner valve needle 22 when the former is moved away from the outer valve seating 30 by an amount which exceeds a distance L. The distance L is defined by the clearance, when both needles 22, 14 are seated, between the upper end surface 60*b* of the spring pin 60 and the surface 122*b* of the enlarged end region 22*c* of the inner valve needle 22.

Operation of the injector will now be described in further detail. Fuel under high pressure is delivered to the upper delivery chamber 46 from the common rail of the injection system. Initially, the piezoelectric actuator 28 is energised and the stack 40 has a relatively extended length. In this situation the inner and outer valve needles 22, 14 are held against their respective seatings 30, 34 due to the forces of their respective springs 36, 32.

Figure 5:
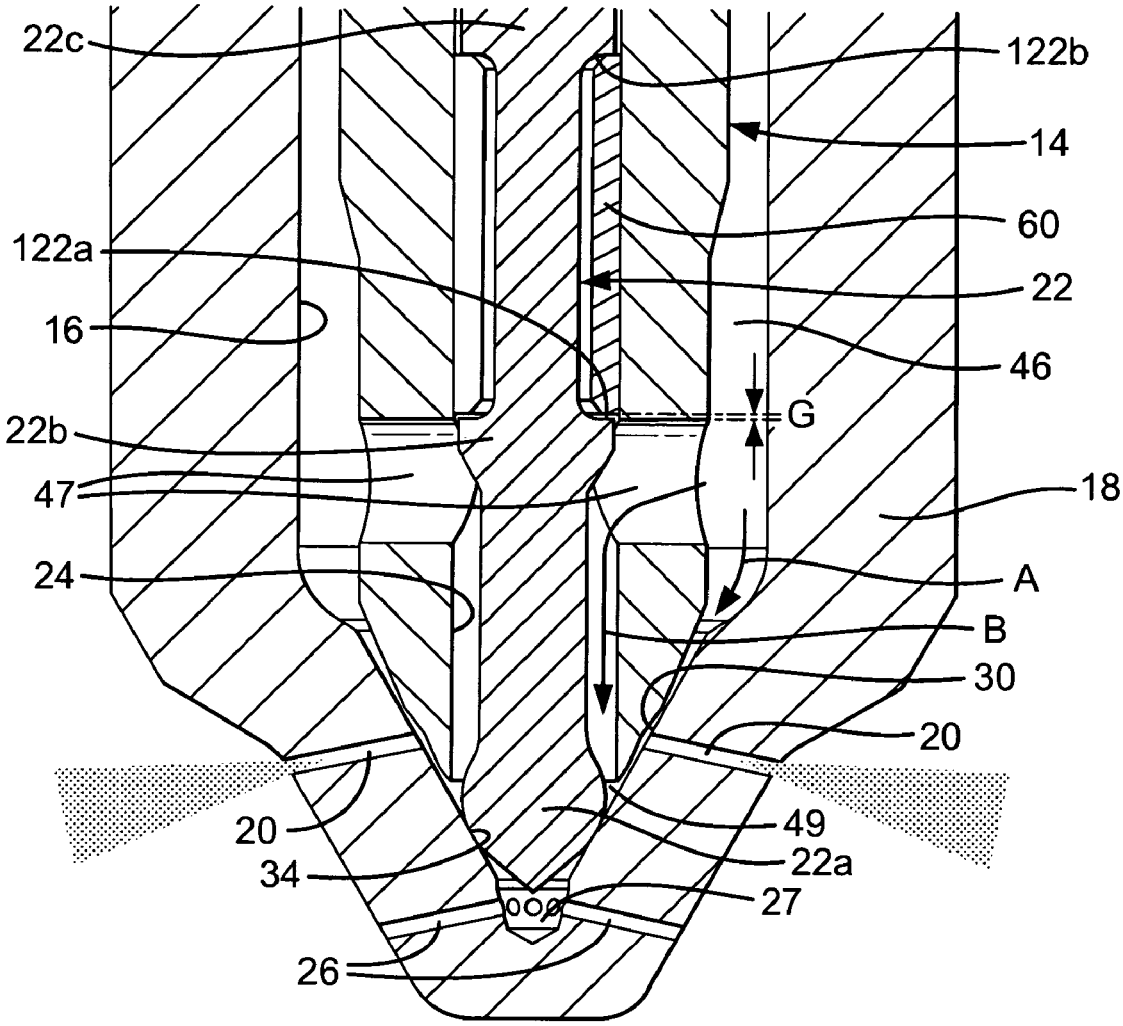
FIG. 5 is a sectional view of the injection nozzle in FIG. 2 when in a first, open state (a first injecting state)

When the piezoelectric actuator 28 is de-energised to a first energisation level, the stack 40 is caused to contract. As a result, a lifting force is transmitted to the outer valve needle 14 through the hydraulic amplifier 37, thus causing the outer valve needle 14 to be moved away from the outer valve seating 30, disengaging both the upper seating line 50 from the upper seat 56 and the lower seating line 52 from the lower seat 58. This is the position of the outer valve needle 14 shown in FIG. 5. During this initial de-energisation of the actuator 28, the outer valve needle 14 is caused to move through a relatively small distance, which is less than the distance L. The resilience of the spring pin 60 causes it to engage frictionally with the axial bore 24 in the outer valve needle 14, so that as the outer valve needle 14 moves it carries the spring pin 60 with it, opening a gap (identified as G in FIG. 5) between the lower surface 122*a* on the stepped region 22*b* of the inner valve needle 22 and the lower surface 60*a* of the pin 60. Providing that the distance through which the outer valve needle 14 is moved is less than the distance L, the upper end of the spring pin 60 does not engage with the enlarged end 22*c* of the inner valve needle 22 which, thus, remains seated against the inner valve seating 34.

When the outer valve needle 14 is in a position in which it is lifted away from the outer valve seating 30, fuel is able to flow from the upper delivery chamber 46, past the upper seat 56, into the annular volume 54 and through the first outlets 20 into the combustion chamber. In addition, fuel is able to flow from the upper delivery chamber 46, through the supplementary flow path defined in the outer valve needle 14 (i.e. the flow path defined by the radial drillings 47 and the axial bore 24) and into the lower delivery chamber 49. Fuel delivered to the lower delivery chamber 49 is able to flow past the exposed lower seat 58, into the annular volume 54 and out through the first outlets 20. Thus, when the outer valve needle 14 is lifted from the outer valve seating 30, there are two paths for fuel flow to the first outlets 20: a first flow path (represented by arrow A) past the upper seat 56, directly from the upper delivery chamber 46, and a second flow path (represented by arrow B) past the lower seat 58, indirectly from the upper delivery chamber 46 via the lower delivery chamber 49.

Providing the outer valve needle 14 is only moved by an amount which is less than distance L, the inner valve needle 22 will remain seated against the inner valve seating 34 as the upper end of the spring pin 60 remains spaced from the enlarged end region 22*c* of the inner valve needle 22 and so that the needles 22, 14 remain de-coupled. With the inner valve needle 22 seated against the inner valve seating 34, fuel is unable to flow from the lower delivery chamber 49, past the inner valve seating 34 and into the second outlets 26 and so injection only takes place through the first outlets 20.

If it is required to terminate injection, the actuator 28 is energised so as to extend the length of the stack 40 and the outer valve needle 14 is seated under the closing force of the spring 32.

Figure 6:
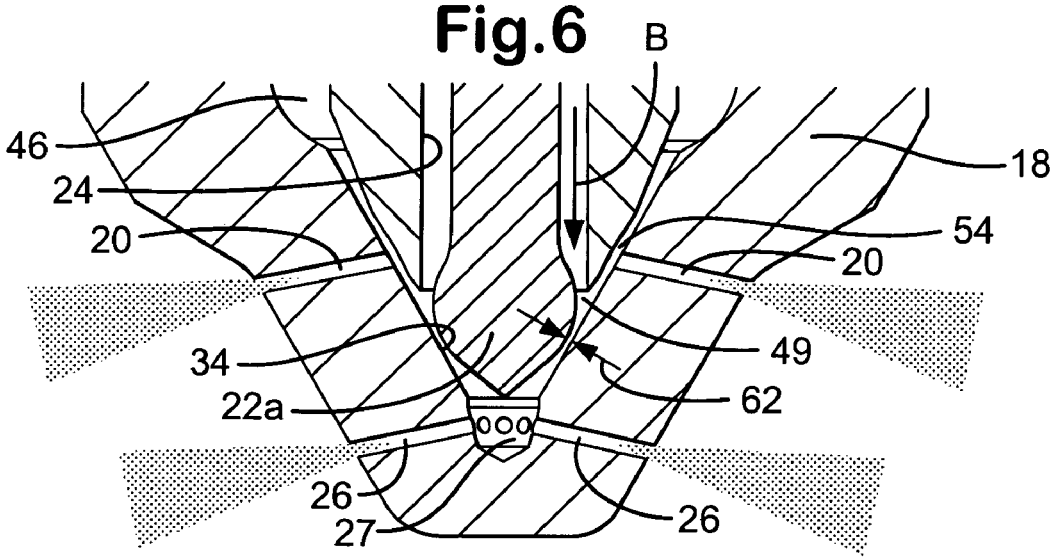
FIG. 6 is a sectional view of the injection nozzle in FIG. 2 when in a second open state (a second injecting state)

Referring to FIG. 6, during a subsequent, or an alternative, stage of injector operation, the piezoelectric actuator 28 may be de-energised further, to a second de-energisation level, causing the length of the stack 40 to be further reduced. As a result, the outer valve needle 14 is lifted away from the outer valve seating 30 by a further amount which is greater than distance L. The upper end surface 60*b* of the spring pin 60 is therefore caused to engage with the enlarged end region 22*c* of the inner valve needle 22. This coupling between the outer and inner valve needles 14, 22 results in the lift force applied to the outer valve needle 14 being transmitted to the inner valve needle 22. The inner valve needle 22 is thus caused to lift from the inner valve seating 34. It will be appreciated that in such circumstances, the surface 122*a* of the stepped region of the inner valve needle 22 and the lower surface 60*a* of the spring pin 60 become separated by a clearance equivalent to distance L.

With the inner valve needle 22 lifted away from the inner valve seating 34, fuel delivered to the lower delivery chamber 49 is able to flow through the second outlets 20 into the combustion chamber. Initially, the second outlets 26 will draw fuel through the supplementary flow path B, defined, in part, by the axial bore 24 in the outer valve needle 14, but as the inner valve needle 22 lifts further it eventually draws fuel both from the supplementary flow path B and from the flow path surrounding the outer valve needle 14 (i.e. flow path A, as identified in FIG. 5).

As the inner valve needle 22 lifts from its seating, a flow restriction 62 (referred to as the "seat restriction") opens up between the outer surface of the seating region 22*a* and the inner valve seating 34. The spheroidal shape of the seating region 22*a* ensures that there is a relatively smooth, and hence efficient, flow as it approaches the seat restriction 62. The flow is diffused downstream of the seat restriction 62 due to the spheroidal part of the seating region 22*a* tapering into the conical end region. It is a benefit of the part-spheroid, part-conical shaping of the seating region 22*a* that the high flow velocity past the seat restriction 62 is smoothly decelerated as the flow continues downstream to the second outlets 26. This ensures that the highest possible pressure is recovered in the nozzle sac volume 27 before flowing into the second outlets 26. This ensures a good flow characteristic is achieved to the second outlets 26, but without the requirement for excessive lift distances for the inner valve needle 22.

A further benefit of the part-spherical searing region 22*a* is realised in that the seal established when the region 22*a* seats against the frustoconical seating surface 34 is less likely to leak fuel in the event of the inner valve needle 22 being forced to lie (for example due to manufacturing tolerances) at an angle relative to the bore 24 of the outer valve needle 14 rather than being exactly coaxial therewith. This is because the spherical section of the seating region 22*a* will maintain a substantially circular contact line with the conical seating surface 34, as opposed to an elliptical contact line that would result if the seating region 22*a* was entirely of frustoconical form.

In a conventional nozzle, the geometry of the valve needle seat has to be selected carefully so as to achieve high impact force resistance as the needle seats and also to have a relatively small sac volume. In the present invention, it is possible to instead optimise the valve seat geometry for high flow efficiency for two reasons. Firstly, the inner valve needle 22 is relatively small and so, having low mass, has a low impact force. Secondly, the nozzle sac volume 27 is only filled with fuel at high engine power modes when problems with hydrocarbon emissions are reduced, due to higher combustion temperatures and the high levels of air let into the engine.

It is one benefit of the present invention that there are two fuel flow paths to the outlets 20 when the outer valve needle 14 is lifted away from the outer valve seating 30, a first flow path directly from the upper delivery chamber 46 and a second flow path indirectly from the upper delivery chamber 46 via the supplementary flow path 47, 24 and the lower delivery chamber 49. Due to the presence of these two flow paths past the seats 56, 58, the lift force required to move the outer valve needle 14 is less than required in a conventional nozzle in which the flow approaches the outlets from only one direction (an upper delivery chamber). The present invention therefore provides the benefit that reduced lift forces are required to be provided by the piezoelectric actuator 28, prolonging actuator service life and providing more efficient injector operation. It is a further advantage of providing two seats 56, 58 for the outer valve needle 14 that only a small annular volume 54 of fuel is exposed to the first outlets 20, and hence to the combustion chamber, when the outer valve needle 14 is seated at the end of injection. This results from communication between the annular volume 54 and the first outlets 20 being closed by contact between the outer valve needle and the lower seat 58 at the end of injection. In conventional injectors, in which only a single seat is provided upstream of the outlets, a much greater volume of fuel downstream of the seat is exposed to the outlets at this time.

A possible method by which the inner and outer valve members 22, 14 can be assembled together will now be described. Initially, the inner valve needle 22 is received into the spring pin 60 so that the lower end surface of the pin 60 abuts against the step 122 on the needle 22. The inner valve needle 22 and the spring pin 60 are sized so as to define that distance L through which the outer valve needle 14 is allowed to move, prior to a lift force being transmitted to the inner valve needle 22 to couple movement of the needles 14, 22 together. Once the spring pin 60 is assembled on the inner valve needle 22, the spring 36 is then inserted into the spring chamber 23 and the combined inner valve needle and spring pin assembly 22, 60 is pushed into the axial bore 24 in the outer valve needle 14.

The assembled inner and outer valve needles 22, 14 are then together inserted into the nozzle body bore 16. The needle assembly 22, 14 must be pushed into the nozzle body bore 16 by precisely the correct amount for the upper and lower seating lines 50, 52 of the outer valve needle 14 to seat against their respective seats 56, 58 and for the seating region 22*a* of the inner valve needle 22 to seat against the inner valve seating 34, with the spring pin 60 correctly positioned to define the required distance L. To achieve the desired setting, the relative positions of the inner and outer valve needles 22, 14 may need to be adjusted once they are within the nozzle body bore 16. This may be achieved by pushing the outer or inner valve needle 14, 22 against its valve seating 30, 34 once the needle assembly 14, 22 is in position within the nozzle body bore 16. To avoid damage being caused to the valve seatings 30, 34, during this final assembly step it may be desirable to use a "dummy" nozzle body (e.g. a tool with a bore having the same cone angle as that of the bore 16) so as to align the needles 22, 14 correctly before they are finally assembled within the actual nozzle body 18.

Figure 7:
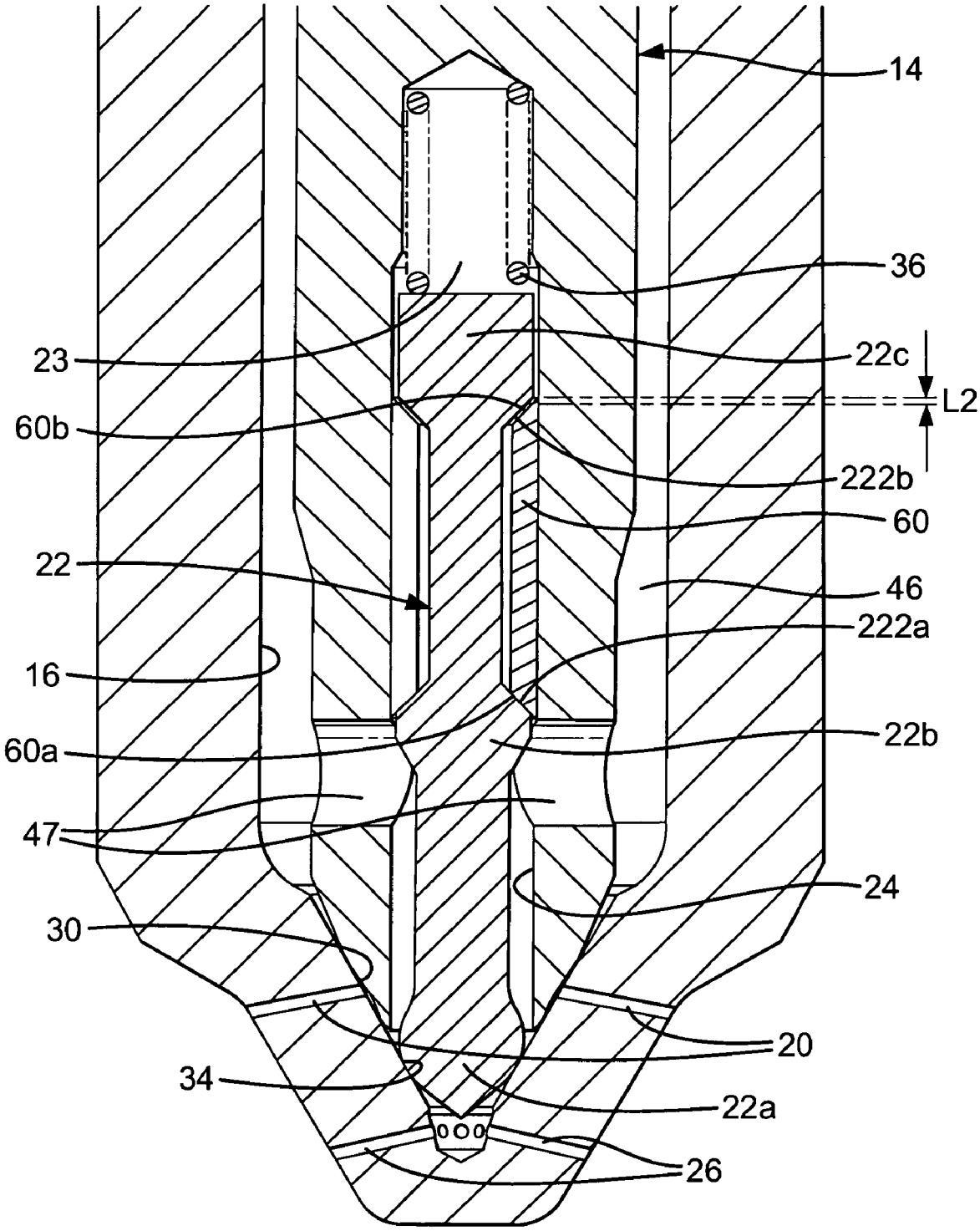
FIG. 7 is a sectional view of an alternative embodiment of the injection nozzle when in a closed state (non-injecting).

An alternative embodiment of the injection nozzle is shown in FIG. 7. Similar parts to those shown in FIGS. 2 to 6 are identified with like reference numerals and so will not be described in further detail. In FIG. 7, respective contact surfaces 222*a* of the stepped region 22*b* of the inner valve needle 22 and the lower end 60*a* of the spring pin 60 are of conical form, rather than being flat (in contrast with FIG. 2). Respective contact surfaces 222*b* of the enlarged end region 22*c* of the inner valve needle 22 and the upper end 60*b* of the spring pin 60 are also of conical form, rather than being flat (also in contrast with FIG. 2). Shaping of the inner valve needle 22 in this way provides a stronger structure and also enables a more convenient centreless grinding technique to be used for manufacture.

It is a possible disadvantage of the conical contact surfaces 222*a*, 222*b* for the spring pin 60 that accurate setting of the distance, L, is more difficult to achieve. This is because the lateral resilience of the spring pin 60 alters its outer diameter when the inner valve needle 22 and spring pin assembly 60 are introduced into the outer valve needle 14 and the spring 60 engages frictionally with the surface of the bore 24.

For the embodiment of FIG. 7 the following sequence of steps may therefore be used to set the distance L accurately. The desired lift distance L is selected beforehand and the inner and outer valve needles 22, 14 and the spring pin 60 are initially assembled so that the actual distance (i.e. between the upper end of the spring pin 60 and the underside of the enlarged end 22*c* of the inner valve needle 22) is slightly larger than the desired value L. Initially, the inner valve needle 22 and the spring pin 60 are assembled together, as described for the previous embodiment, and then the assembly 22, 60 is pushed into the axial bore 24 in the outer valve needle 14 (with the closing spring 36 in place in the chamber 23). This step may be achieved by pushing the inner valve needle 22 into the axial bore 24 by reacting against the nozzle body bore 16. The outer valve needle 14 is then pushed, against the closing spring 36, until the upper and lower seating lines 50, 52 thereof contact the upper and lower seats 56, 58 respectively of the outer valve seating 30, with the inner valve seating region 22*a* in contact with the inner valve seating 34. The distance, L2, through which the outer valve needle 14 must be moved during this 'pushing' step is then measured. The difference between the measured distance, L2, and the selected distance, L, is calculated. If this difference is zero, the inner and outer valve needles 22, 14 are assembled correctly to give the desired distance L. If not, the inner valve needle 22 must be pushed further into the axial bore 24, and the previous steps repeated, until a measured distance of zero if achieved.

As mentioned previously, if there are concerns about damaging the surface of the seating 34 as the inner valve needle 22 is pushed into the axial bore 24, a dummy nozzle body tool having a bore with the same cone angle as that of the actual nozzle body bore 16 may be used for this step of the setting process.

Although the injection nozzle has been described as suitable for forming part of a piezoelectric injector, in practice the injector may include a different type of actuator. For example, the outer valve needle may be moveable by means of an electromagnetic actuator. It will also be appreciated that, if a piezoelectric actuator is used, the actuator may be mechanically coupled to the outer valve needle or alternatively may be coupled to the outer valve needle through hydraulic means. Additionally, although the foregoing description assumes that the piezoelectric injector is of the de-energise-to-inject type, where a de-energisation of the actuator stack results in needle lift to commence injection, the actuator and coupling to the outer valve needle may be configured in an energise-to-inject manner.

The nozzle of the invention is also applicable to injectors in which the inner and outer valve needles are controlled independently of one another. For example, separate actuators may be provided for each of the inner and outer valve needles, or a single actuator may be used to control the hydraulic forces applied to the needles 14, 22. The feature of the embodiments in FIGS. 1 to 7, that movement of the inner valve needle is coupled to the outer valve needle once the outer valve needle is lifted beyond a predetermined distance, is not therefore an essential feature of the present invention.

The invention claimed is:

1. An injection nozzle for an internal combustion engine, the injection nozzle comprising;

an outer valve needle that is engageable with an outer valve seating so as to control injection through a first nozzle outlet, an inner valve needle that is movable within the outer valve needle and engageable with an inner valve seating so as to control injection through a second nozzle outlet, and a coupling arrangement for coupling movement of the outer valve needle to the inner valve needle in circumstances in which the outer valve needle is moved away from the outer valve seating beyond a predetermined amount, thereby to permit fuel injection through both the first and second nozzle outlets, wherein the outer valve seating defines first and second seats for the outer valve needle, co-operation between the outer valve needle and the first seat controlling fuel flow between a first delivery chamber and the first nozzle outlet and co-operation between the outer valve needle and the second seat controlling fuel flow between a second delivery chamber and the first nozzle outlet, the second delivery chamber communicating with the first delivery chamber by way of a supplementary flow path defined, at least partially, within the outer valve needle, wherein the coupling arrangement includes a resilient member carried by the outer valve needle, the resilient member being brought into engagement with the inner valve needle following movement of the outer valve needle beyond the predetermined amount so as to cause the inner valve needle to move together with the outer valve needle, and wherein the resilient member takes the form of a spring pin having lateral resilience.

2. The injection nozzle as claimed in claim 1, wherein the outer valve needle is provided with an axial bore within which the inner valve needle is received, and wherein the supplementary flow path is defined, in part, by a region of the axial bore.

3. The injection nozzle as claimed in claim 2, wherein the supplementary flow path is further defined by at least one radial passage provided in the outer valve needle, wherein the radial passage effects communication between the first delivery chamber and the axial bore.

4. The injection nozzle as claimed in claim 1, wherein the resilient member is carried by the outer valve needle through frictional engagement.

5. The injection nozzle as claimed in claim 1, wherein the resilient member includes a first contact surface for engagement with a second contact surface of the inner valve needle, wherein said contact surfaces are substantially flat.

6. The injection nozzle as claimed in claim 1, wherein the resilient member includes a first contact surface for engagement with a second contact surface of the inner valve needle, wherein said contact surfaces are of substantially frusto-conical form.

7. The injection nozzle as claimed in claim 1, wherein the inner valve needle includes a seating region that is engageable with the inner valve seating, the seating region including a region of pan-spheroid form that defines, together with the inner valve searing, a seat restriction through which fuel flows between the second delivery chamber and the second nozzle outlet in circumstances in which the inner valve needle is lifted away from the inner valve seating.

8. The injection nozzle as claimed in claim 7, wherein the seating region includes a region of conical form downstream of the part-spheroid region so as to have a decelerating effect on fuel flow velocity downstream of the seat restriction.

9. An injector for use in a fuel injection system of an internal combustion engine, wherein the injector includes an injection nozzle as claimed in claim 1 and an actuator for actuating movement of the outer valve needle.

10. The injector as claimed in claim 9, wherein the actuator is a piezoelectric actuator.

11. An injection nozzle for an internal combustion engine, the injection nozzle comprising:

an outer valve needle that is engageable with an outer valve seating so as to control injection through a first nozzle outlet, an inner valve needle that is movable within the outer valve needle and engageable with an inner valve seating so as to control injection through a second nozzle outlet, and a coupling arrangement for coupling movement of the outer valve needle to the inner valve needle in circumstances in which the outer valve needle is moved away from the outer valve seating beyond a predetermined amount thereby to permit fuel injection through both the first and second nozzle outlets, wherein the outer valve seating defines first and second seats for the outer valve needle, co-operation between the outer valve needle and the first seat controlling fuel flow between a first delivery chamber and the first nozzle outlet and co-operation between the outer valve needle and the second seat controlling fuel flow between a second delivery chamber and the first nozzle outlet, the second delivery chamber communicating with the first delivery chamber by way of a supplementary flow path defined, at least partially, within the outer valve needle, wherein the coupling arrangement includes a resilient member carried by the outer valve needle, the resilient member being brought into engagement with the inner valve needle following movement of the outer valve needle beyond the predetermined amount so as to cause the inner valve needle to move together with, the outer valve needle.

wherein the resilient member takes the form of a spring pin having lateral resilience, and wherein an outer surface of the spring pin is in frictional engagement with the axial bore in the outer valve needle to couple the spring pin and the outer valve needle together.

12. An injection nozzle for an internal combustion engine, the injection nozzle comprising:

an outer valve needle that is engageable with an outer valve seating so as to control injection through a first nozzle outlet an inner valve needle that is movable within the outer valve needle and engageable with an inner valve seating so as to control injection through a second nozzle outlet, and a coupling arrangement for coupling movement of the outer valve needle to the inner valve needle in circumstances in which the outer valve needle is moved away from the outer valve seating beyond a predetermined amount, thereby to permit fuel injection through both the first and second nozzle outlets, wherein the coupling arrangement includes a spring pin having lateral resilience, the spring pin being positioned so as to cause the inner valve needle to move together with the outer valve needle in circumstances in which the outer valve needle is moved away from the outer valve seating beyond a predetermined amount, wherein the outer valve seating defines first and second seats for the outer valve needle, co-operation between the outer valve needle and the first seat controlling fuel flow between a first delivery chamber and the first nozzle outlet and co-operation between the outer valve needle and the second seat controlling fuel flow between a second delivery chamber and the first nozzle outlet, the second delivery chamber communicating with the first delivery chamber by way of a supplementary flow path defined, at least partially, within the outer valve needle, and wherein the inner valve needle includes a seating region that is engageable with the inner valve seating, the seating region including a region of part-spheroid form that defines, together with the inner valve seating, a seat restriction through which fuel flows between the second delivery chamber and the second nozzle outlet in circumstances in which the inner valve needle is lifted away from the inner valve seating.

13. The injection nozzle as claimed in claim 12, wherein the seating region includes a region of conical form downstream, of the part-spheroid region so as to have a decelerating effect on fuel flow velocity downstream of the seat restriction.

14. The Injection nozzle as claimed in claim 12, wherein the outer valve needle is provided with an axial bore within which the inner valve needle is received, and wherein the supplementary flow path is defined, in part, by a region of the axial bore.

15. The injection nozzle as claimed in claim 14, wherein the supplementary flow path is further defined by at least one radial passage provided in the outer valve needle, wherein the radial passage effects communication between the first delivery chamber and the axial bore.

16. The injection nozzle as claimed in claim 12, further comprising a coupling arrangement for coupling movement of the outer valve needle to the inner valve needle in circumstances in which the outer valve needle is moved away from the outer valve seating beyond a predetermined amount, thereby to permit fuel injection through both the first and second nozzle outlets.

17. An injector for use in a fuel injection system of an internal combustion engine, wherein the injector includes an injection nozzle as claimed in claim 12 and an actuator for actuating movement of the outer valve needle.

18. The injector as claimed in claim 17, wherein the actuator is a piezoelectric actuator.

19. An injector for use in a fuel injection system of an internal combustion engine, wherein the injector includes an injection nozzle as claimed in claim 12, a first actuator for actuating movement of the outer valve needle and a second actuator for actuating movement of the inner valve needle.

20. The injector as claimed in claim 19, wherein at least one of the actuators is a piezoelectric actuator.

* * * * *